US009644634B2

(12) United States Patent
Zhang et al.

(10) Patent No.: US 9,644,634 B2
(45) Date of Patent: May 9, 2017

(54) METHOD AND SYSTEM FOR SYNCHRONOUSLY INHIBITING SUBCRITICAL VIBRATIONS OF MAGNETIC LEVITATION MOLECULAR PUMP ROTOR

(71) Applicants: KYKY TECHNOLOGY CO., LTD., Beijing (CN); TSINGHUA UNIVERSITY, Beijing (CN)

(72) Inventors: Kai Zhang, Beijing (CN); Han Wu, Beijing (CN); Qizhi Li, Beijing (CN); Xiaozhang Zhang, Beijing (CN); Meng Zou, Beijing (CN)

(73) Assignees: KYKY TECHNOLOGY CO., LTD., Beijing (CN); TSINGHUA UNIVERSITY, Beijing (CN)

( * ) Notice: Subject to any disclaimer, the term of this patent is extended or adjusted under 35 U.S.C. 154(b) by 466 days.

(21) Appl. No.: 14/363,725

(22) PCT Filed: Nov. 22, 2012

(86) PCT No.: PCT/CN2012/085064
§ 371 (c)(1),
(2) Date: Jul. 21, 2014

(87) PCT Pub. No.: WO2013/082998
PCT Pub. Date: Jun. 13, 2013

(65) Prior Publication Data

US 2014/0356126 A1 Dec. 4, 2014

(30) Foreign Application Priority Data

Dec. 8, 2011 (CN) ..... 2011 1 0407350

(51) Int. Cl.
*F04D 27/00* (2006.01)
*F04D 29/66* (2006.01)
(Continued)

(52) U.S. Cl.
CPC ..... *F04D 27/001* (2013.01); *F04D 19/042* (2013.01); *F04D 19/048* (2013.01);
(Continued)

(58) Field of Classification Search
CPC ..... F04D 19/04; F04D 19/042; F04D 19/048; F04D 27/00; F04D 27/001; F04D 29/048;
(Continued)

(56) References Cited

U.S. PATENT DOCUMENTS 7,501,782 B2 * 3/2009 Buhler ..... F16C 32/0442 310/90.5
2010/0054957 A1 3/2010 Goetze et al.

FOREIGN PATENT DOCUMENTS

CN 1920511 A 2/2007
CN 101.187589 A 5/2008
(Continued)

*Primary Examiner* — Gregory Anderson
*Assistant Examiner* — Alexander White
(74) *Attorney, Agent, or Firm* — Birch, Stewart, Kolasch & Birch, LLP

(57) ABSTRACT

A method for synchronously inhibiting subcritical vibrations of magnetic levitation molecular pump rotor, by use of synchronously sampling signals of subcritical vibrations of the rotor generated after the rotor of the magnetic levitation molecular pump touches down so as to obtain the amplitude and the phase of subcritical vibrations of the rotor, based on which a compensation force is output for inhibiting subcritical vibrations of the rotor. Through using the present method, an accurate synchronous for signals of subcritical vibrations and fast inhibition for subcritical vibrations of the rotor is achieved.

6 Claims, 3 Drawing Sheets

(51) Int. Cl.
*F04D 19/04* (2006.01)
*F04D 29/58* (2006.01)
*F04D 29/058* (2006.01)

(52) U.S. Cl.
CPC ..... *F04D 27/00* (2013.01); *F04D 29/058* (2013.01); *F04D 29/58* (2013.01); *F04D 29/661* (2013.01); *F04D 29/668* (2013.01)

(58) Field of Classification Search
CPC ..... F04D 29/058; F04D 29/58; F04D 29/661; F04D 29/662; F04D 29/668; F05B 2240/51; F05B 2240/511; F05B 2260/96; F05B 2260/964
See application file for complete search history.

(56) References Cited

FOREIGN PATENT DOCUMENTS

| | | | |
|---|---|---|---|
| CN | 101495760 | A | 7/2009 |
| CN | 102425563 | A | 4/2012 |
| EP | 1 650 411 | A2 | 4/2006 |

* cited by examiner

METHOD AND SYSTEM FOR SYNCHRONOUSLY INHIBITING SUBCRITICAL VIBRATIONS OF MAGNETIC LEVITATION MOLECULAR PUMP ROTOR

FIELD OF THE INVENTION

The present invention relates to a magnetic levitation molecular pump, in particular a method and system for synchronously inhibiting subcritical vibrations of magnetic levitation molecular pump rotor.

BACKGROUND OF THE INVENTION

The magnetic levitation molecular pump is taking advantage of a magnetic bearing adapted for suspending the rotor of the molecular pump in the air, so that there is no contact, friction and no lubrication is required during the rotation of the rotor of the magnetic levitation molecular pump with a high speed. Because of the aforesaid advantages of the magnetic levitation molecular pump, it is widely applied for obtaining vacuum environment with high vacuum and high cleanliness.

The structure of the magnetic levitation molecular pump is shown in FIG. 1, comprising a body of the magnetic levitation molecular pump, a rotor of the magnetic levitation molecular pump, a motor of the magnetic levitation molecular pump, a first radial magnetic bearing, a second radial magnetic bearing, a first axial magnetic bearing, a second axial magnetic bearing, a first radial protective bearing, a second radial protective bearing, an axial protective bearing, a first radial displacement sensor, a second radial displacement sensor, an axial displacement sensor and a controller of the magnetic levitation molecular pump, etc.

The rotor is stably suspended in a predetermined suspension center when the magnetic levitation molecular pump is working normally. The rotor may come into a state of subcritical vibrations when the rotor touches down to the protective bearing due to its instability caused by external disturbance. The subcritical vibration means a vibration whose frequency is less than a frequency that is synchronization with the rotating speed of the rotor. The subcritical vibration of the rotor mainly represents as a circular vortex motion, whose moving track is shown in FIG. 3, wherein, the circular vortex motion indicates a form of motion that the axial of the rotor moves back and forth around the center of a bearing. At this moment, the magnetic bearing comes into a nonlinear state, thus typical controller of the magnetic bearing cannot control the magnetic bearing for providing appropriate magnetic force so as to control the rotor effectively. The method for inhibiting subcritical vibrations of a magnetic levitation molecular pump rotor of prior art is quite roughly, and the typical controller of the magnetic bearing is unable to synchronize accurately with signals of subcritical vibrations of the rotor, thus cannot solve the problem of subcritical vibrations occurred in a circumstance of the rotor touch down, which means subcritical vibrations of the rotor cannot be effectively inhibited.

SUMMARY OF THE INVENTION

In view of the forgoing, the present invention aims at solving at least one technical problem of prior art that for example, the controller of the magnetic levitation molecular pump of prior art is unable to synchronize accurately with signals of subcritical vibrations of the rotor, thus it cannot effectively inhibit subcritical vibrations of the rotor. The present invention provides a method and a system for synchronously inhibiting subcritical vibrations of a magnetic levitation molecular pump rotor.

To solve the above technical problems, the present invention provides a method for synchronously inhibiting subcritical vibrations of a magnetic levitation molecular pump rotor, sequentially comprising steps of:

step 1: controlling a digital signal processor through a controller of the magnetic levitation molecular pump after the rotor of the magnetic levitation molecular pump touches down due to its instability, so as to obtain a radial displacement signal of the rotor; executing Fast Fourier Transform of the displacement signal, and then analyzing a spectrum of the rotor vibrations to obtain a frequency $f_0$ and amplitude $A_0$ of the subcritical vibrations of the rotor;

step 2: establishing a Cartesian coordinate system by taking an inner center of a stator of a radial magnetic bearing as an origin, and setting a position A on the track of the subcritical vibrations of the rotor as an origin point synchronous with the subcritical vibrations of the rotor; then obtaining a phase $\phi_0$ of the subcritical vibrations of the rotor, when an angle formed by the vector of the displacement of the rotor and the positive X axis is a predetermined angle $\Phi$, which indicates the rotor reaches the position A; outputting a compensation force so as to inhibit the subcritical vibrations of the rotor according to the frequency $f_0$, the amplitude $A_0$ and the phase $\phi_0$ of the subcritical vibrations of the rotor, based on the sine rule, when the rotor reaches the position A;

step 3: when the rotor reaches the position A again, enabling the digital signal processor for executing a single frequency Fast Fourier Transformation of the rotor displacement during a next period of the subcritical vibrations of the rotor, so as to obtain amplitude $A_i$ and a phase $\phi_i$ of the subcritical vibrations of the rotor, wherein, setting the frequency of the single frequency Fast Fourier Transformation as a current subcritical frequency $f_i$ of the rotor; comparing the amplitude $A_i$ and the phase $\phi_i$ of the current subcritical vibrations of the rotor with the amplitude $A_{i-1}$ and the phase $\phi_{i-1}$ of a previous period of the subcritical vibrations through the controller of the magnetic levitation molecular pump, and making corresponding revise to the amplitude and the phase of a compensation force of the next period of the subcritical vibrations; repeating this step till a predetermined period is passed;

step 4: executing a Fast Fourier Transformation of a displacement signal of the rotor at an interval of a predetermined period T through the digital signal processor, so as to obtain an updated frequency $f_j$ of the subcritical vibrations of the rotor, and setting $f_j$ as the frequency of the compensation force for the next period of the subcritical vibrations;

step 5: determining if the amplitude of the subcritical vibrations of the rotor decreases to a value below a predetermined threshold in every period of the subcritical vibrations through the controller of the magnetic levitation molecular pump; completing inhibition to the subcritical vibrations of the rotor, when the detected amplitude of the subcritical vibrations of the rotor is lower than the predetermined threshold and meanwhile the rotor is entirely disengaged with the protective bearing, otherwise, repeating with step 3 to step 4.

In a class of this embodiment, the angle formed by the displacement vector of the rotor and the positive X axis is zero degree.

In a class of this embodiment, in the step 3, the frequency of the compensation force is equal to the frequency of the subcritical vibrations; the compensation force is proportional to the amplitude of the subcritical vibrations, with contrary phase.

In a class of this embodiment, in the step 4, the predetermined period T may be equivalent to 5-15 periods of the subcritical vibrations of the rotor.

The present invention further provides a system for synchronously inhibiting subcritical vibrations of a magnetic levitation molecular pump rotor, adapted for executing the method mentioned above, wherein comprising:

a displacement sensor;

a controller of the magnetic levitation molecular pump, adapted for controlling the displacement sensor for obtaining a displacement signal of the rotor of the magnetic levitation molecular pump and controlling the working of components of the system;

a digital signal processor, adapted for obtaining the frequency, amplitude and phase of the subcritical vibrations of the rotor through receiving and analyzing the displacement signal of the rotor obtained by the controller, and for transmitting the frequency, the amplitude and the phase to the controller;

a magnetic bearing, adapted for being controlled by the controller so as to output a compensation force for inhibiting the subcritical vibrations of the rotor according to the predetermined frequency, the amplitude and the phase.

In a class of this embodiment, the predetermined period T may be equivalent to 10 periods of the subcritical vibrations of the rotor.

Advantages of the present invention are summarized below:

It is provided in the present invention a method for synchronously sampling signals of subcritical vibrations of the rotor generated after the rotor of the magnetic levitation molecular pump touches down so as to obtain the amplitude and the phase of subcritical vibrations of the rotor, based on which outputting a compensation force for inhibiting subcritical vibrations of the rotor. Through using the present method, it is achieved of accurate synchronous for signals of subcritical vibrations and fast inhibition for subcritical vibrations of the rotor.

DESCRIPTION OF THE DRAWINGS

Detailed description will be given below in conjunction with accompanying drawings.

Figure 1:
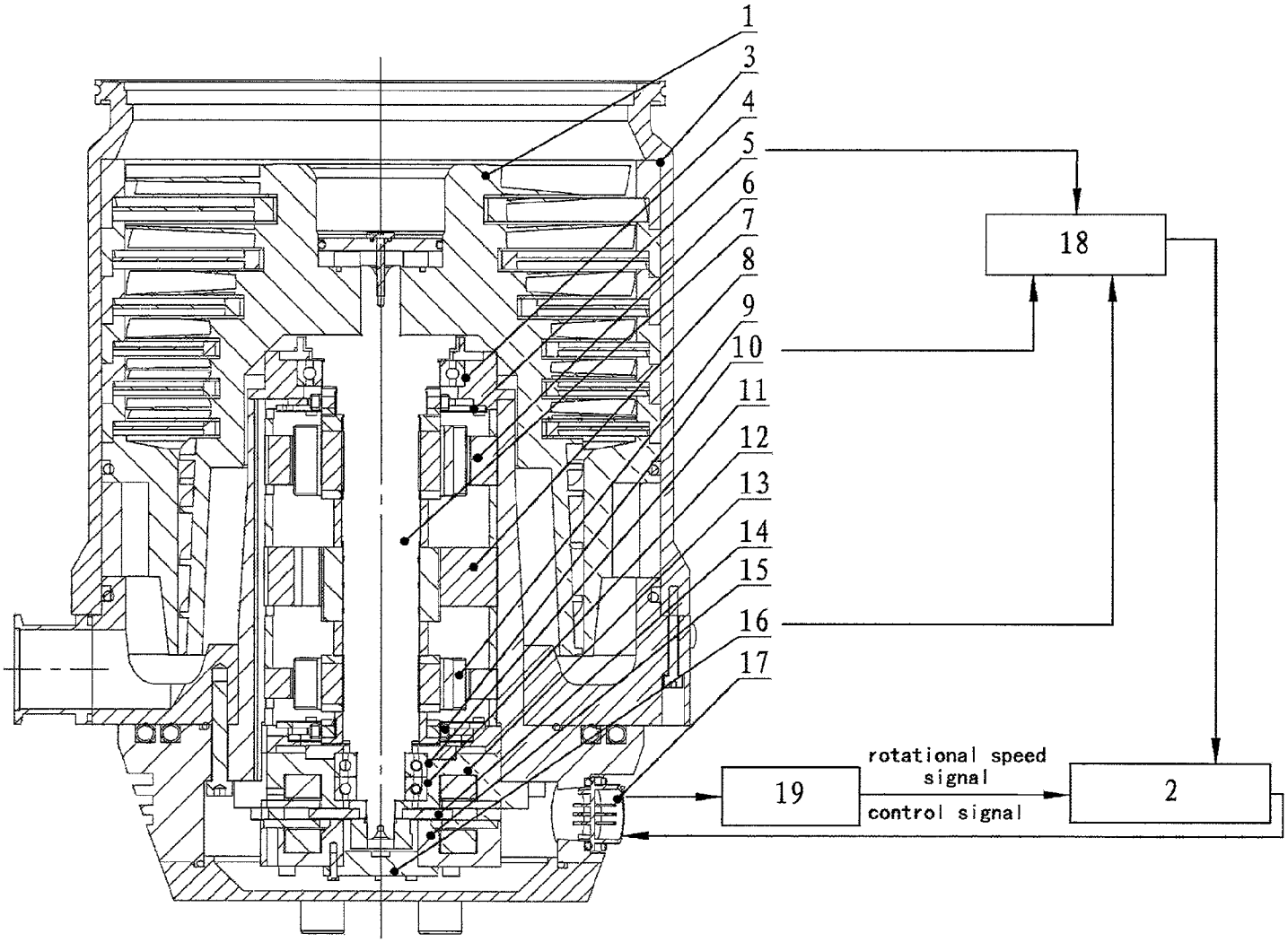
FIG. 1 shows an inner structure of a magnetic levitation molecular pump.

In the drawings, the following reference numbers are used:

1—flywheel, 2—controller of a magnetic levitation molecular pump, 3—pump body, 4—first radial protective bearing, 5—first radial displacement sensor, 6—first radial magnetic bearing, 7—rotor shaft, 8—motor, 9—second radial magnetic bearing, 10—second radial displacement sensor, 11—second radial protective bearing, 12—axial protective bearing, 13—first axial magnetic bearing, 14—thrust plane, 15—second axial magnetic bearing, 16—axial displacement sensor, 17—connector, 18—displacement detector, 19—rotational speed detector.

DETAILED DESCRIPTION OF THE EMBODIMENTS

Figure 2:
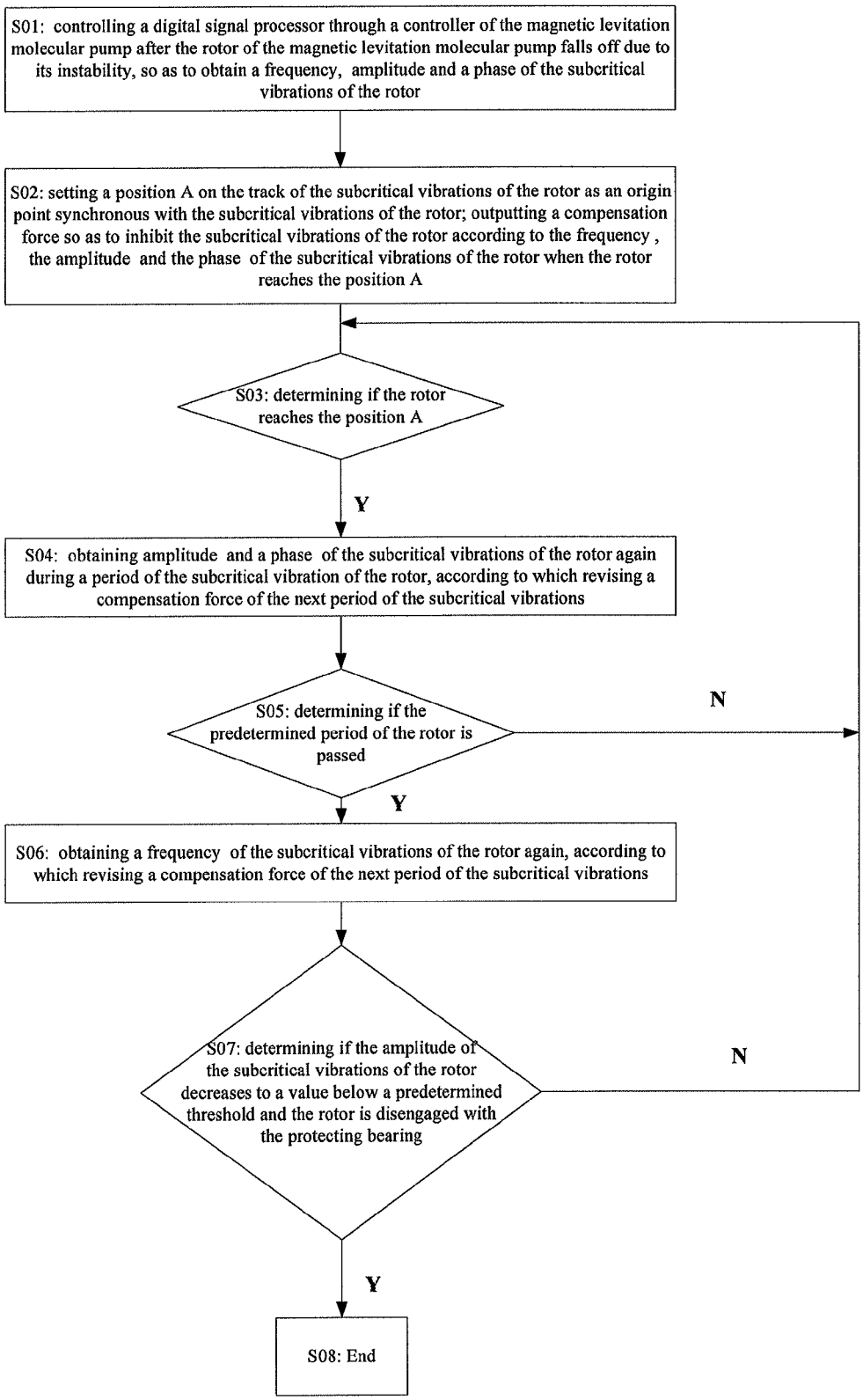
FIG. 2 is a flow chart of the control method of the present invention.
Figure 3:
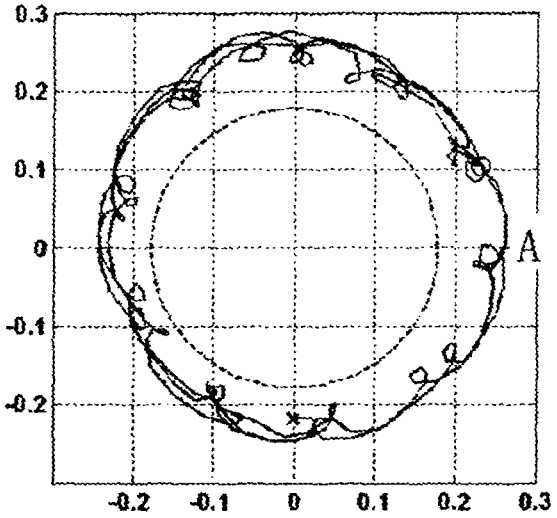
FIG. 3 is a schematic diagram of subcritical vibrations of the rotor of the magnetic levitation molecular pump.

Referring to FIG. 2, it shows one embodiment of the present invention that provides a method for synchronously inhibiting subcritical vibrations of a magnetic levitation molecular pump rotor, comprising steps of:

step S01, controlling a digital signal processor through a controller of the magnetic levitation molecular pump after the rotor of the magnetic levitation molecular pump touches down due to its instability, so as to obtain a displacement signal of the rotor; executing Fast Fourier Transformation (known as FFT for short) of the rotor displacement signal, and then analyzing a spectrum of vibrations of the rotor to obtain a frequency $f_0$ and amplitude $A_0$ of the subcritical vibrations of the rotor;

step S02, establishing a Cartesian coordinate system by taking an inner center of a stator of a radial magnetic bearing as an origin, and setting a position A on the track of the subcritical vibrations of the rotor as an origin point synchronous with the subcritical vibrations of the rotor; then obtaining a phase $\phi_0$ of the subcritical vibrations of the rotor, when an angle formed by the vector of the displacement of the rotor and the positive X axis is a predetermined angle $\Phi$, which indicates the rotor reaches the position A; outputting a compensation force so as to inhibit the subcritical vibrations of the rotor according to the frequency $f_0$, the amplitude $A_0$ and the phase $\phi_0$ of the subcritical vibrations of the rotor, based on the sine rule, when the rotor reaches the position A;

step S03, determining if the rotor of the magnetic levitation molecular pump reaches the position A again, if yes, then moving to the next step;

step S04, enabling the digital signal processor by the controller of the magnetic levitation molecular pump for sampling displacement signals of the rotor measured by the displacement sensor during a next period of subcritical vibrations of the rotor from position A, and executing a single frequency Fast Fourier Transformation of such signals, so as to obtain amplitude $A_i$ and a phase $\phi_i$ of the subcritical vibrations of the rotor, wherein, setting the frequency of the Fast Fourier Transformation as a current subcritical frequency $f_i$ of the rotor; comparing the amplitude $A_i$ and the phase $\phi_i$ of the current subcritical vibrations of the rotor with the amplitude $A_{i-1}$ and the phase $\phi_{i-1}$ of a previous period of the subcritical vibrations through the controller of the magnetic levitation molecular pump, and making corresponding revise to the amplitude and the phase of a compensation force of the next period of the subcritical vibrations; repeating this step till a predetermined period is passed;

step S05, determining if the predetermined period of the rotor is passed, if yes, then moving to the next step; the period T of predetermined vibrations is determined by both the speed of the hardware and the frequency of subcritical vibrations of the rotor, which is preferable to be updated every 10 periods of subcritical vibrations of the rotor, and satisfied results can also be obtained for updating every 5-15 periods of subcritical vibrations of the rotor.

step S06, executing a Fast Fourier Transformation of a displacement signal of the rotor at an interval of a predetermined period T through the digital signal processor, so as to obtain an updated frequency $f_j$ of the subcritical vibrations of the rotor, and revising the frequency of the compensation force for the next period of subcritical vibrations of the rotor according to the obtained frequency $f_j$, i.e. setting $f_j$ as the frequency of the compensation force for the next period of the subcritical vibrations;

step S07, determining if the amplitude of the subcritical vibrations of the rotor decreases to a value below a predetermined threshold in every period of the subcritical vibrations through the controller of the magnetic levitation molecular pump; completing inhibition to the subcritical vibrations of the rotor, when the amplitude of the subcritical vibrations of the rotor is lower than the predetermined threshold and meanwhile the rotor is entirely disengaged with the protective bearing, which means the rotor resumes rotating normally, then moving to step S9 for completing the entire controlling process; otherwise, turning back to step S04; step S08, ending.

It is provided in the present embodiment a method for synchronously sampling signals of subcritical vibrations of the rotor generated after the rotor of the magnetic levitation molecular pump touches down so as to obtain the amplitude and the phase of subcritical vibrations of the rotor, based on which outputting a compensation force for inhibiting subcritical vibrations of the rotor. Through using the present method, it is achieved of accurate synchronous for signals of subcritical vibrations and fast inhibition for subcritical vibrations of the rotor.

In the aforesaid controlling method, because of slow changes of the frequency of subcritical vibrations of the rotor, it is allowed to execute a Fast Fourier Transform of the displacement signal of the rotor once by the digital signal processor every predetermined period T of vibrations, and to further obtain an updated frequency of subcritical vibrations of the rotor, and to revise the frequency of the compensation force of the next period of subcritical vibrations with the updated frequency, i.e. to set the frequency of the compensation force of the next period of subcritical vibrations to be equal to the updated frequency of subcritical vibrations of the rotor.

Furthermore, because of the incorporation of the compensation force, the amplitude of the rotor changes in every period of subcritical vibrations, thus it is required to make corresponding revises to the amplitude compensation force of the next period of subcritical vibrations. More specifically, the method for revising comprises steps of: when the rotor reaches the position A, enabling the digital signal processor for executing a single frequency Fast Fourier Transformation of the displacement of the rotor during a next period of the subcritical vibrations of the rotor, so as to obtain amplitude and a phase of the subcritical vibrations of the rotor, wherein, setting the frequency of the single frequency Fast Fourier Transformation as a current subcritical frequency of the rotor; comparing the amplitude and the phase of the current subcritical vibrations of the rotor with the amplitude and the phase of a previous period of the subcritical vibrations through the controller of the magnetic levitation molecular pump, and making corresponding revises to the amplitude and the phase of a compensation force of the next period of the subcritical vibrations.

Accordingly, another embodiment of the present invention provides a system for synchronously inhibiting subcritical vibrations of a magnetic levitation molecular pump rotor comprising: a displacement sensor; a controller of the magnetic levitation molecular pump, adapted for controlling the displacement sensor for obtaining a displacement signal of the rotor of the magnetic levitation molecular pump and controlling the working of components of the system; a digital signal processor, adapted for obtaining a frequency, amplitude and a phase of the subcritical vibrations of the rotor through receiving and analyzing the displacement signal of the rotor obtained by the controller, and for transmitting the frequency, the amplitude and the phase to the controller; a magnetic bearing, adapted for being controlled by the controller so as to output a compensation force for inhibiting the subcritical vibrations of the rotor according to the predetermined frequency, the amplitude and the phase. Every components of the system may be controlled by the controller of the magnetic levitation molecular pump which is adapted for executing the aforesaid steps of the embodiment so as to synchronous inhibit of subcritical vibrations of the rotor of the magnetic levitation molecular pump.

It should be noted that as other embodiments of the present invention, for the position A, the angle formed by the displacement vector of the rotor and the positive X axis can be other values, for example, 30 degree or 50 degree, which can also achieve the objectives of the present invention and should be protected by the present invention.

Although the present invention has been described with particular reference to certain preferred embodiments thereof, variations and modifications of the present invention can be effected within the spirit and scope of the claims.

The invention claimed is:

1. A method for synchronously inhibiting subcritical vibrations of a magnetic levitation molecular pump rotor, wherein the method sequentially comprises the following steps of:

step 1: controlling a digital signal processor through a controller of said magnetic levitation molecular pump after said rotor of said magnetic levitation molecular pump falls off due to instability of the rotor, so as to obtain a displacement signal of said rotor; executing a Fast Fourier Transformation of said displacement signal, and then analyzing a spectrum of vibrations of said rotor to obtain a frequency $f_0$ and amplitude $A_0$ of the subcritical vibrations of said rotor;

step 2: establishing a Cartesian coordinate system by taking an inner center of a stator of a radial magnetic bearing as an origin, and setting a position A on a track of the subcritical vibrations of said rotor as an origin point synchronous with the subcritical vibrations of said rotor; then obtaining a phase $\phi_0$ of the subcritical vibrations of said rotor, when a positive angle formed by a vector of a displacement of said rotor and the coordinate X axis reaches a predetermined angle $\Phi$, which indicates said rotor reaches said position A; outputting a compensation force so as to inhibit the subcritical vibrations of said rotor according to the frequency $f_0$, the amplitude $A_0$ and the phase $\phi_0$ of the subcritical vibrations of said rotor, based on the sine rule, when said rotor reaches said position A;

step 3: when said rotor reaches said position A again, enabling said digital signal processor for executing a single frequency Fast Fourier Transformation of the displacement of said rotor during a next period of the subcritical vibrations of said rotor, so as to obtain amplitude $A_i$ and a phase $\phi_i$ of the subcritical vibrations of said rotor, wherein, setting a frequency of said single frequency Fast Fourier Transformation as a current subcritical frequency $f_i$ of said rotor; comparing the amplitude $A_i$ and the phase $\phi_i$ of the current subcritical vibrations of said rotor with the amplitude $A_{i-1}$ and the phase $\phi_{i-1}$ of a previous period of the subcritical vibrations through said controller of said magnetic levitation molecular pump, and making corresponding revisions to an amplitude and a phase of a compensation force of the next period of the subcritical vibrations; repeating this step till a predetermined period is passed;

step 4: executing a Fast Fourier Transformation of a displacement signal of said rotor at an interval of a predetermined period T through said digital signal processor, so as to obtain an updated frequency $f_i$ of the subcritical vibrations of said rotor, and setting the updated frequence $f_j$ as the frequency of the compensation force for the next period of the subcritical vibrations;

step 5: determining if the amplitude of the subcritical vibrations of said rotor decreases to a value below a predetermined threshold in every period of the subcritical vibrations through said controller of said magnetic levitation molecular pump; completing inhibition to the subcritical vibrations of said rotor, when a detected amplitude of the subcritical vibrations of said rotor is lower than said predetermined threshold and meanwhile said rotor is entirely disengaged with a protective bearing, otherwise, repeating step 3 to step 4.

2. The method of claim 1, wherein said positive angle formed by said displacement vector of said rotor and said coordinate X axis is zero degrees.

3. The method of claim 2, wherein in said step 3, the frequency of said compensation force equals the frequency of said subcritical vibrations; said compensation force is proportional to the amplitude of said subcritical vibrations, with contrary phase.

4. The method of claim 3, wherein in said step 4, said predetermined period T may be equivalent to 5-15 periods of the subcritical vibrations of said rotor.

5. The method of claim 4, wherein said predetermined period T may be equivalent to 10 periods of the subcritical vibrations of said rotor.

6. A system for synchronously inhibiting subcritical vibrations of a magnetic levitation molecular pump rotor, adapted for executing the method of claim 1, wherein the system comprises:

a position sensor;

a controller of said magnetic levitation molecular pump, adapted for controlling said position sensor for obtaining a displacement signal of said rotor of said magnetic levitation molecular pump and controlling the working of components of said system;

a digital signal processor, adapted for obtaining a frequency, an amplitude and a phase of the subcritical vibrations of said rotor through receiving and analyzing said displacement signal of said rotor obtained by said controller, and for transmitting the frequency, the amplitude and the phase to said controller;

a magnetic bearing, adapted for being controlled by said controller so as to output a compensation force for inhibiting the subcritical vibrations of said rotor according to the frequency, the amplitude and the phase;

after said rotor of said magnetic levitation molecular pump falls off due to instability of the rotor, the digital signal processor is controlled by the controller to:

obtain a displacement signal of said rotor; execute a Fast Fourier Transformation of said displacement signal, and then analyze a spectrum of vibrations of said rotor to obtain a frequency $f_0$ and amplitude $A_0$ of the subcritical vibrations of said rotor;

establish a Cartesian coordinate system by taking an inner center of a stator of a radial magnetic bearing as an origin, and set a position A on a track of the subcritical vibrations of said rotor as an origin point synchronous with the subcritical vibrations of said rotor; then obtain a phase $\phi_0$ of the subcritical vibrations of said rotor, when a positive angle formed by a vector of a displacement of said rotor and the coordinate X axis reaches a predetermined angle $\Phi$, which indicates said rotor reaches said position A; cause the magnetic bearing to output a compensation force so as to inhibit the subcritical vibrations of said rotor according to the frequency $f_0$, the amplitude $A_0$ and the phase $\phi_0$ of the subcritical vibrations of said rotor, based on the sine rule, when said rotor reaches said position A;

execute a single frequency Fast Fourier Transformation of the displacement of said rotor during a next period of the subcritical vibrations of said rotor after said rotor reaches said position A again, so as to obtain amplitude $A_i$ and a phase $\phi_i$ of the subcritical vibrations of said rotor, wherein, a frequency of said single frequency Fast Fourier Transformation is set as a current subcritical frequency $f_i$ of said rotor; compare the amplitude $A_i$ and the phase $\phi_i$ of the current subcritical vibrations of said rotor with the amplitude $A_{i-1}$ and the phase $\phi_{i-1}$ of a previous period of the subcritical vibrations, and make corresponding revisions to an amplitude and a phase of a compensation force of the next period of the subcritical vibrations; repeat this step till a predetermined period is passed;

execute a Fast Fourier Transformation of a displacement signal of said rotor at an interval of a predetermined period T, so as to obtain an updated frequency $f_j$ of the subcritical vibrations of said rotor, and setting the updated frequency $f_j$ as the frequency of the compensation force for the next period of the subcritical vibrations;

determine if the amplitude of the subcritical vibrations of said rotor decreases to a value below a predetermined threshold in every period of the subcritical vibrations; complete inhibition to the subcritical vibrations of said rotor, when a detected amplitude of the subcritical vibrations of said rotor is lower than said predetermined threshold and meanwhile said rotor is entirely disengaged with a protecting bearing, otherwise, repeat step 3 to step 4.

* * * * *